US008316868B2

(12) United States Patent
Poyner et al.

(10) Patent No.: US 8,316,868 B2
(45) Date of Patent: Nov. 27, 2012

(54) LEAK CONTROL SYSTEM AND DISHWASHER INCORPORATING THE SAME

(75) Inventors: Dennis A. Poyner, Kinston, NC (US); David Sumner, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 855 days.

(21) Appl. No.: 12/334,914

(22) Filed: Dec. 15, 2008

(65) Prior Publication Data

US 2010/0148644 A1 Jun. 17, 2010

(51) Int. Cl.
*B08B 3/02* (2006.01)

(52) U.S. Cl. ..... 134/104.2; 134/200

(58) Field of Classification Search ..... 134/200; 68/196

See application file for complete search history.

(56) References Cited

U.S. PATENT DOCUMENTS

| | | | | | |
|---|---|---|---|---|---|
| 2,261,338 | A | * | 11/1941 | Carlson | 141/107 |
| 2,633,959 | A | * | 4/1953 | Von Stoeser | 194/241 |
| 3,208,641 | A | * | 9/1965 | Brugioni | 222/108 |
| 3,294,461 | A | * | 12/1966 | Barnard et al. | 312/213 |
| 4,765,697 | A | * | 8/1988 | Gardell et al. | 312/229 |
| 6,401,733 | B1 | | 6/2002 | Schrott et al. | |
| 6,474,351 | B1 | | 11/2002 | Cerruti et al. | |
| 6,718,993 | B1 | | 4/2004 | DeMartini | |
| 6,817,367 | B2 | | 11/2004 | Flowers et al. | |
| 7,014,281 | B2 | * | 3/2006 | Wuestefeld et al. | 312/204 |
| 7,216,944 | B2 | * | 5/2007 | Oyler et al. | 312/311 |
| 7,506,655 | B2 | * | 3/2009 | Assmann | 134/56 D |
| 2007/0175907 | A1 | | 8/2007 | Kempe et al. | |

FOREIGN PATENT DOCUMENTS

| | | | |
|---|---|---|---|
| DE | 26 13 671 | * | 10/1977 |
| DE | 31 07 239 | * | 9/1982 |
| DE | 101 18 632 A1 | | 10/2002 |
| GB | 2 189 136 | * | 10/1987 |
| JP | 11000300 A | | 1/1999 |
| JP | 2001-204673 | * | 7/2001 |

* cited by examiner

*Primary Examiner* — Frankie L Stinson
(74) *Attorney, Agent, or Firm* — Alston & Bird LLP

(57) ABSTRACT

Provided is a dishwasher door. The door may include a door panel member having a liquid dispenser unit mounted thereto and extending therethrough from an interior-facing side to an exterior-facing side of the door panel member. A fluid-directing member can operably engage with the door panel member about the exterior-facing side. The fluid-directing member may define a containment portion that at least partially surrounds the liquid dispenser unit. The fluid-directing member may also include a conduit in communication with the containment portion. The conduit can be configured to channel liquid leaking from the liquid dispenser unit from the containment portion and through the door panel member, away from the exterior-facing side of said door panel member.

28 Claims, 8 Drawing Sheets

LEAK CONTROL SYSTEM AND DISHWASHER INCORPORATING THE SAME

FIELD OF THE INVENTION

The present invention is directed to dishwashers, to dishwasher doors, to leak protection apparatuses, and to leak control systems, more particularly, to dishwashers, to dishwasher doors, to leak protection apparatuses, and to leak control systems including a fluid-directing member.

BACKGROUND

A dishwasher generally includes a tub having a forward-facing vertical opening, wherein a door is engaged with the tub so as to be pivotable about the lower end of the tub and to close the tub opening during the washing process. Such a dishwasher door may often include a control panel engaged therewith. Accordingly, appropriate wires or a dedicated wiring harness, connecting to the control panel, are often run through the interior of the door, so as to be both hidden from view and separated from the tub portion of the dishwasher. Dishwasher doors often include a detergent dispenser that is coupled to the interior-facing portion of the door and extends somewhat into the interior of the door. However, the area around a detergent dispenser may be susceptible to fluid leakage, such as a rinse agent leakage, into the interior of the door. A typical dishwasher door may not be configured to prevent such fluid leakage from contacting the wiring harness, which contact may cause deterioration of the insulation of the wires of the wiring harness and can lead to a fire hazard.

SUMMARY

In one aspect, a door, such as a dishwasher door, is provided. The door may include a door panel member having a liquid dispenser unit mounted thereto and extending therethrough from an interior-facing side to an exterior-facing side of the door panel member. A fluid-directing member can be operably engaged with the door panel member about the exterior-facing side. The fluid-directing member may be a unitary structure and may define a containment portion that at least partially surrounds the liquid dispenser unit. The fluid-directing member may also include a conduit in communication with the containment portion. The conduit can be configured to channel liquid leaking from the liquid dispenser unit from the containment portion and through the door panel member, away from the exterior-facing side of said door panel member. The door may further include a port extending from the exterior-facing side to the interior-facing side of said door panel member, and the conduit may be configured to channel leaking liquid to the port.

The door may further include at least one wire, for example, configured to be connected to a control panel coupled to the door. The wire may extend along the exterior-facing side of said door panel member in laterally spaced-apart relation to said containment portion and conduit. The fluid-directing member can define a wire conduit that is laterally spaced-apart from the containment portion and conduit, the wire conduit being configured to direct the wire along the exterior-facing side of the door panel member. The door may be configured to be pivotably coupled to a tub portion of a dishwasher, for example, so as to pivot into a closed position relative to the tub portion, whereby the door panel member is substantially vertically-oriented, such that the conduit defined by said fluid-directing member extends downwardly from said containment portion.

In another aspect, a leak protection apparatus for a dishwasher door is provided. The dishwasher door can include a door panel member having a liquid dispenser unit mounted thereto and extending therethrough from an interior-facing side to an exterior-facing side of said door panel member. The leak protection apparatus can include a fluid-directing member defining a containment portion and including a conduit in communication with and extending from the containment portion. The fluid-directing member can be adapted to operably engage the exterior-facing side of the door panel member such that the containment portion at least partially surrounds the liquid dispenser unit. The conduit can be configured to channel liquid leaking from the liquid dispenser unit from the containment portion, and through the door panel member, away from the exterior-facing side of the door panel member. The fluid-directing member can define a wire conduit that is laterally spaced-apart from the containment portion and conduit, the wire conduit being configured to direct at least one wire along the exterior-facing side of the door panel member when the fluid-directing member is operably engaged with the door panel member.

In yet another aspect, a leak control system for a dishwasher is provided. The leak control system can include an inner door panel member pivotably mounted to a tub portion and having a liquid dispenser unit mounted thereto. The liquid dispenser unit may have a portion extending through the inner door panel member. A fluid-directing member can be operably engaged with an outward side of inner door panel member, and can define a containment portion configured to at least partially surround the portion of the liquid dispenser unit extending through the inner door panel member. The containment portion may be configured to contain any liquid leaking from the liquid dispenser unit, outwardly of the outward side of the inner door panel member. The fluid-directing member may further define a channel member in communication with the containment portion and configured to channel the leaking liquid from the containment portion to a port extending into the tub portion of the dishwasher. The fluid-directing member may at least partially define a wiring chase in laterally spaced apart relation with respect to the containment portion and channel member. The wiring chase can be configured to contain therein any wiring extending to a console of the dishwasher so as to prevent the wiring from being contacted by the leaking liquid.

In still another aspect, a dishwasher is provided. The dishwasher includes a tub portion and a door pivotably coupled to the tub portion. The door may include a door panel member having a liquid dispenser unit mounted thereto and extending therethrough from an interior-facing side to an exterior-facing side of the door panel member. A fluid-directing member can be operably engaged with the door panel member about the exterior-facing side. The fluid-directing member may define a containment portion that at least partially surrounds the liquid dispenser unit. The fluid-directing member may also include a conduit in communication with the containment portion. The conduit can be configured to channel liquid leaking from the liquid dispenser unit from the containment portion and through the door panel member, away from the exterior-facing side of said door panel member. The door may further include a port extending from the exterior-facing side to the interior-facing side of said door panel member, and the conduit may be configured to channel leaking liquid to the port.

BRIEF DESCRIPTION OF THE SEVERAL VIEWS OF THE DRAWING(S)

Reference will be made to the accompanying drawings, which are not necessarily drawn to scale, and wherein.

Figure 7:
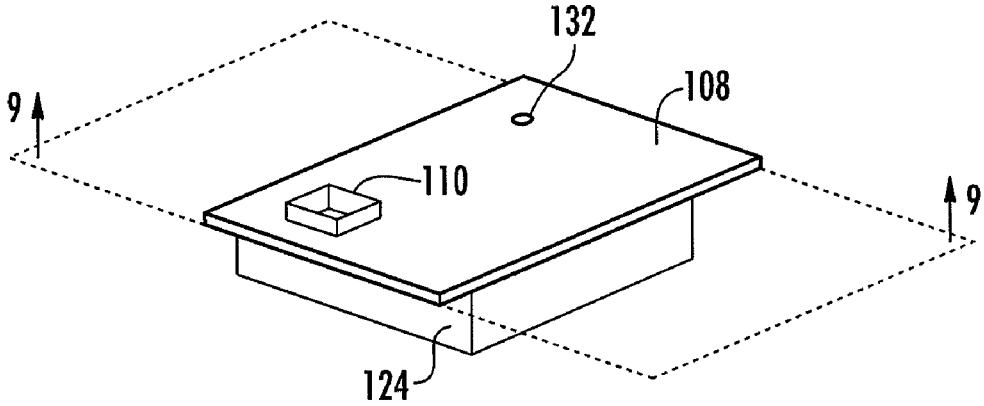
FIGS. 7 and 8 are a perspective and side view, respectively, of the door panel member and fluid-directing member of FIG. 3B.
Figure 8:
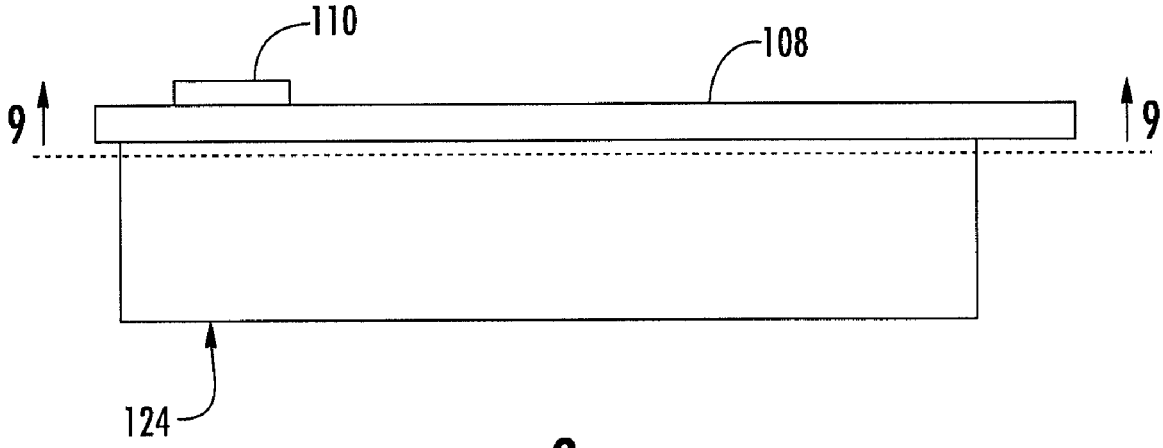
Figure 9:
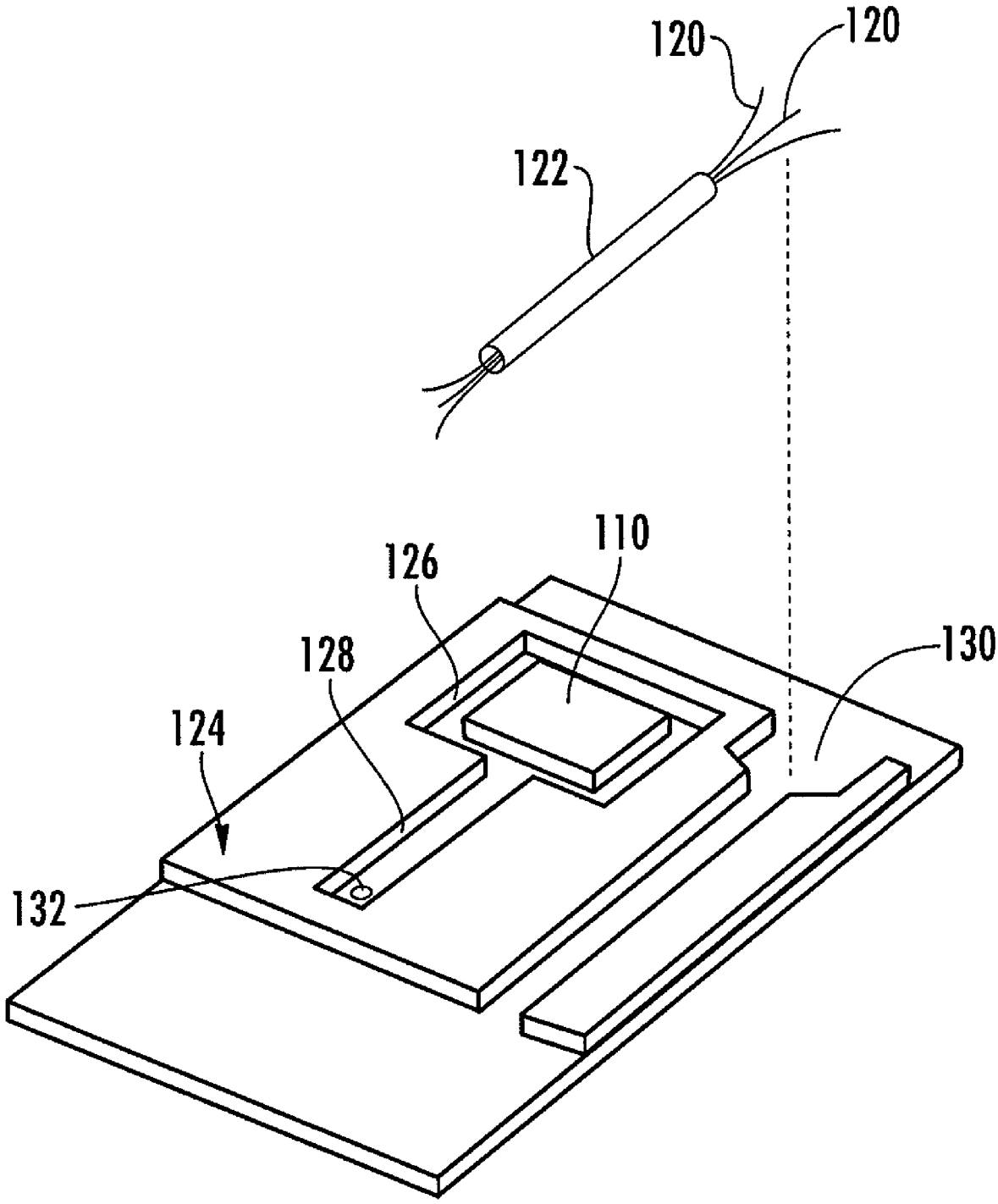
Figure 10:
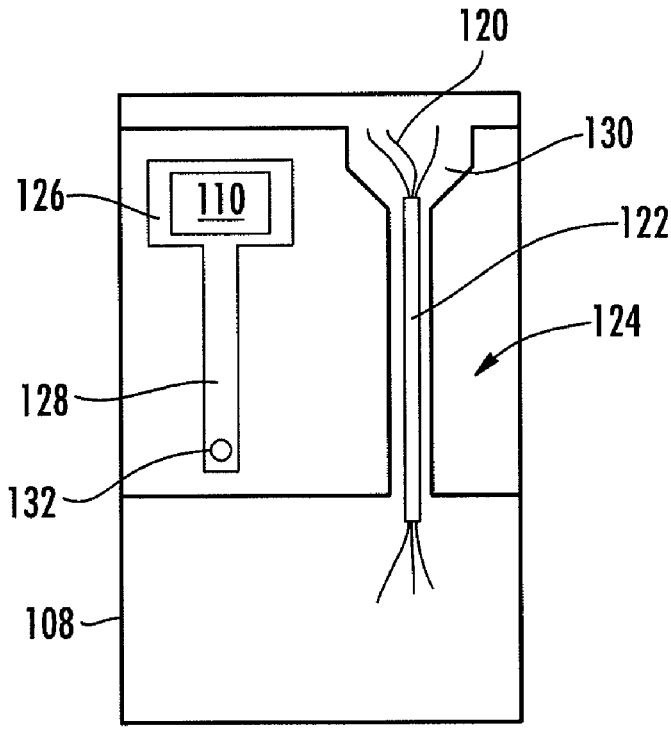
Figure 11:
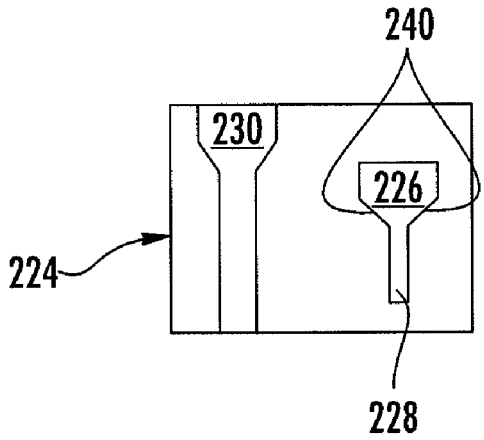

FIGS. 9 and 10 are a perspective view and a plan view, respectively, of the door panel member and fluid-directing member of FIGS. 7 and 8, the fluid-directing member being cross-sectioned at plane 9-9 of FIGS. 7 and 8; and FIG. 11 is a plan view of a fluid-directing member configured in accordance with another example embodiment.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
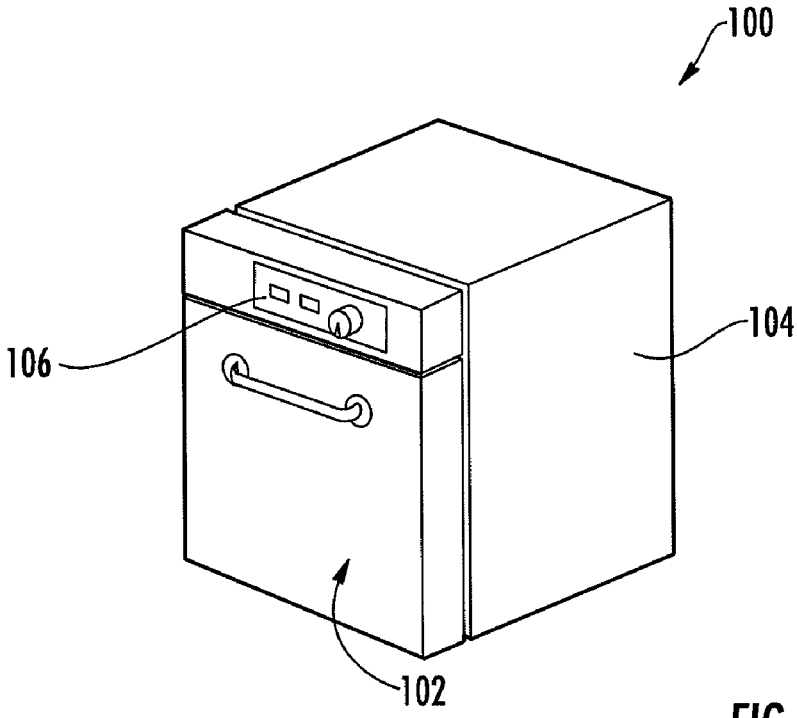
FIGS. 1 and 2 show perspective views of a dishwasher configured in accordance with an example embodiment, the dishwasher being in a "closed" and "open" configuration, respectively.
Figure 2:
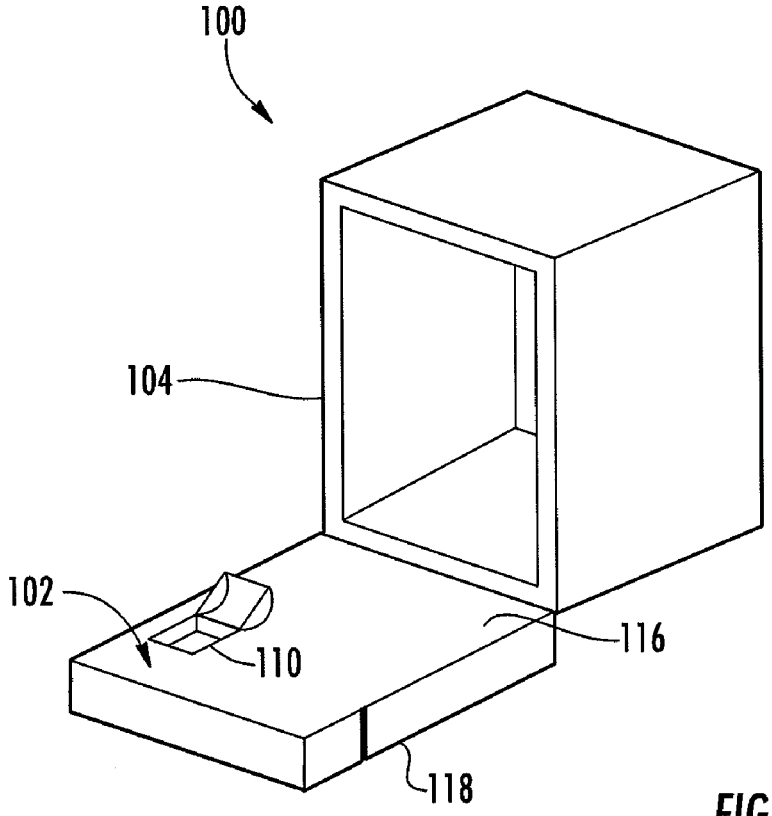
Figure 3A:
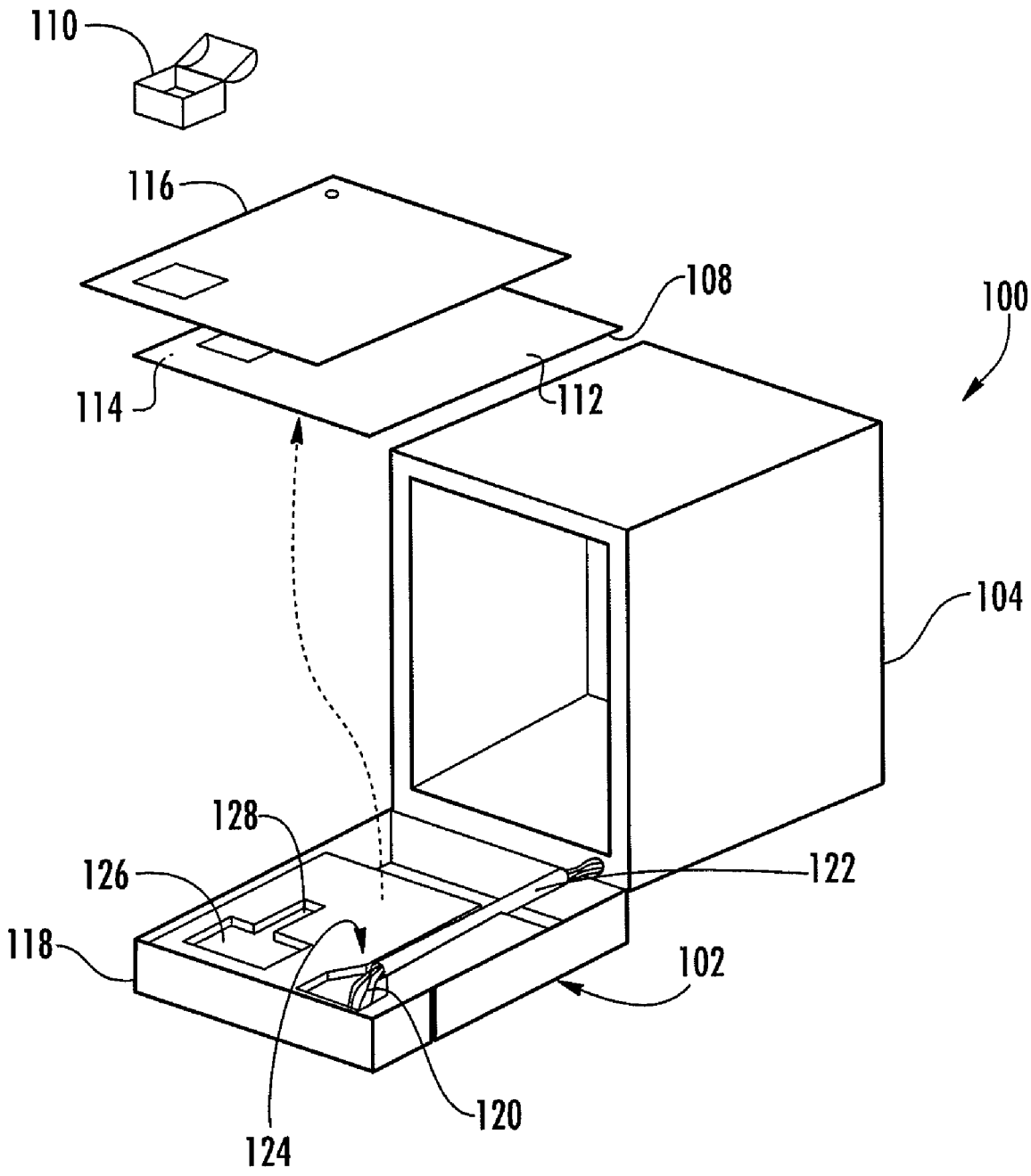
FIG. 3A is a perspective view of the dishwasher of FIG. 1 with the door partially exploded.
Figure 3B:
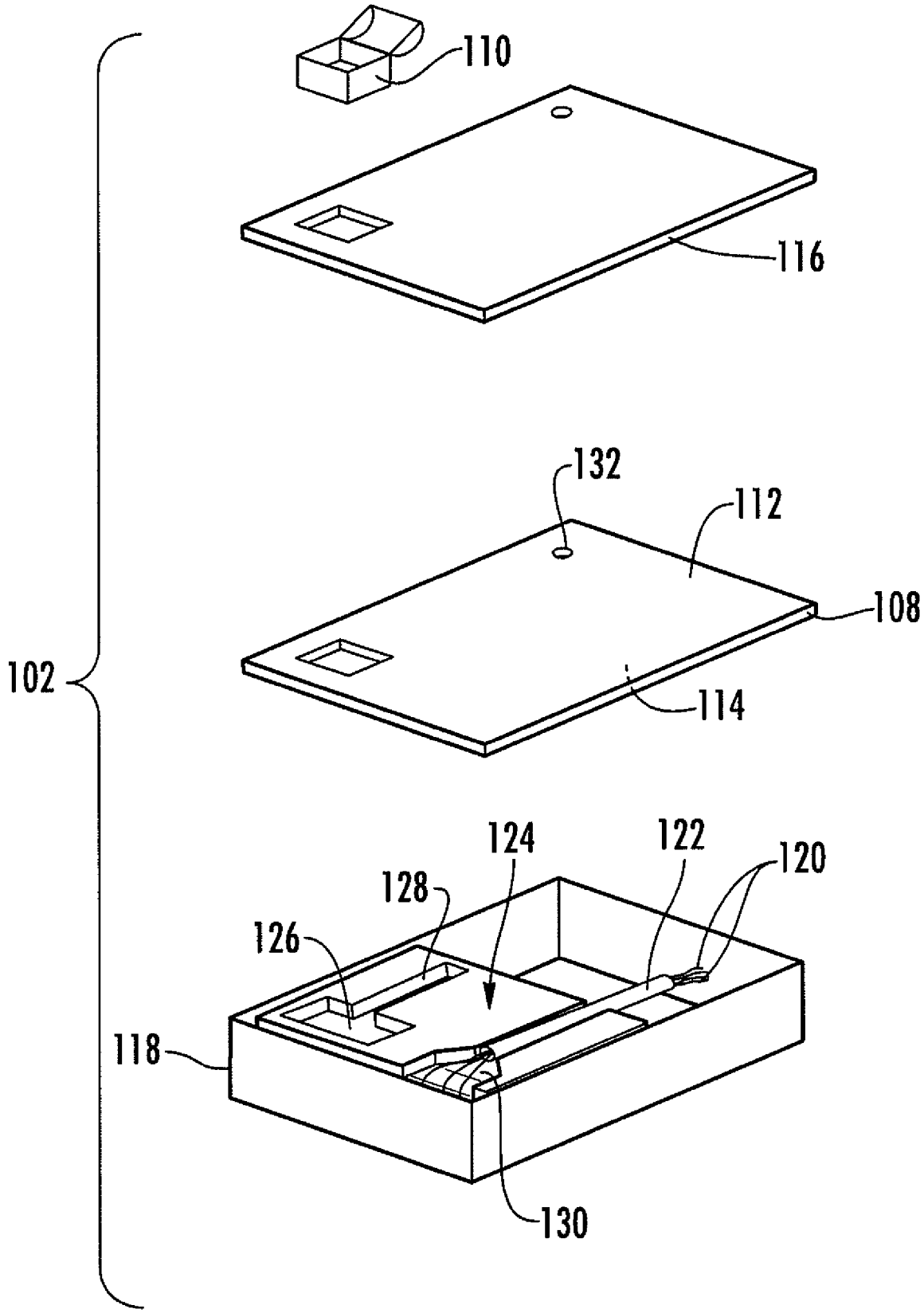
FIG. 3B is a perspective view of the door of FIG. 3A.
Figure 4:
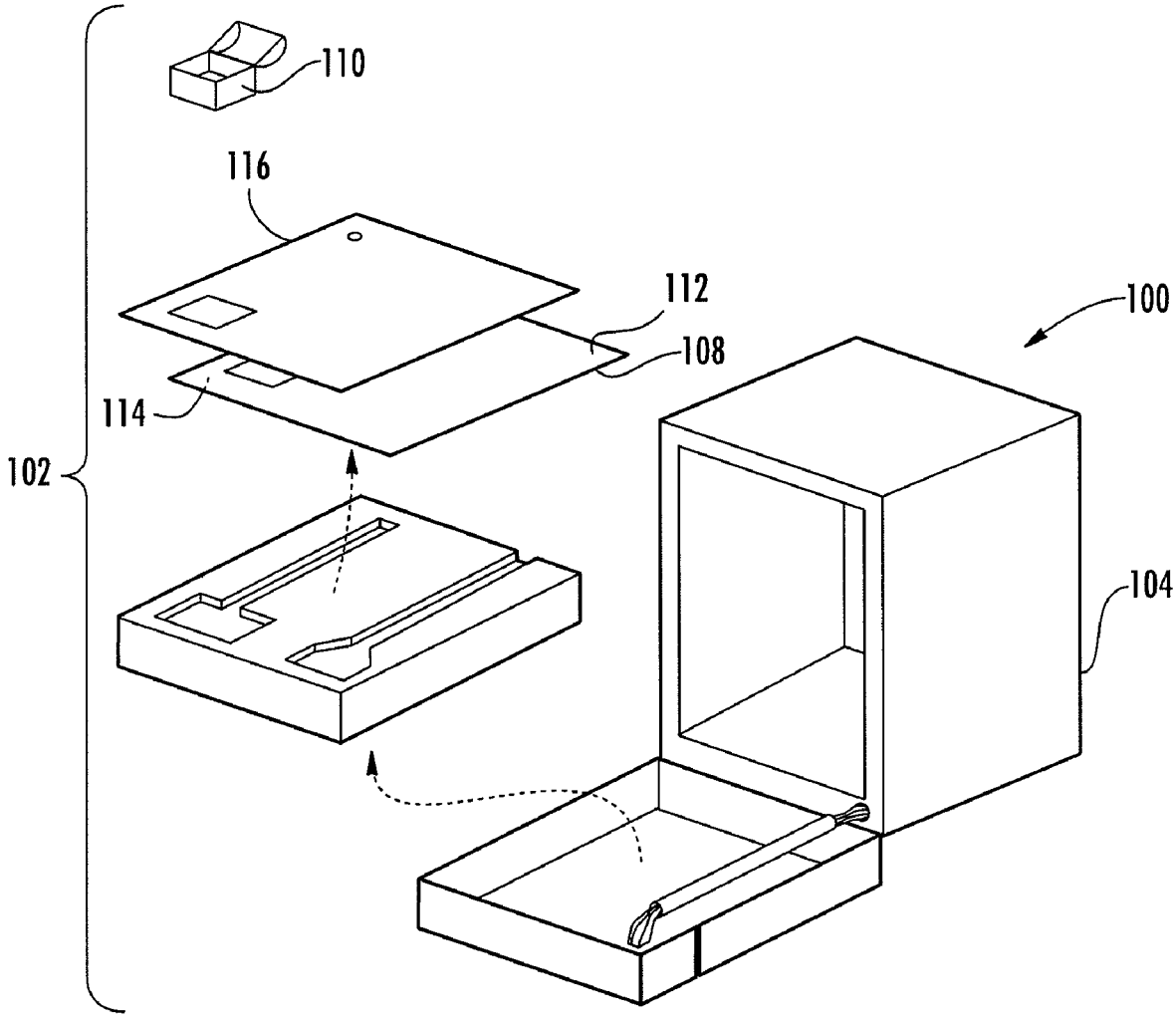
FIG. 4 is a perspective view of the dishwasher of FIG. 1 with the door exploded.

Referring to FIGS. 1 and 2, therein are shown perspective views of a dishwasher 100 configured in accordance with an example embodiment, the dishwasher being in a "closed" and "open" configuration, respectively. The dishwasher 100 includes a dishwasher door 102, which may be pivotably coupled to a tub portion 104. The tub portion 104 may have a forward-facing vertical opening, and the door 102 may be configured to pivot about a lower end of the tub portion into a closed position relative to the tub portion, whereby the door is substantially vertically-oriented and acts to enclose the volume defined by the tub portion. A control panel 106 may be coupled to the dishwasher door 102, for example, by being integrated into the door or otherwise coupled thereto. The control panel 106 may include a user interface for controlling the operation of the dishwasher and initiating/controlling a washing procedure.

Referring to FIGS. 1, 3A, 3B, and 4, the dishwasher door 102 may include a door panel member 108 having a liquid dispenser unit 110 mounted thereto and extending therethrough from an interior-facing side 112 to an exterior-facing side 114 of the door panel member. The liquid dispenser unit 110 may be used, for example, to dispense detergent and/or a rinse agent into the tub portion 104. The door panel member 108 may be made, for example, of metal or a polymeric material. A inner liner 116 made of, for example, polymeric material, may be coupled to the door panel member 108, such as by staking the door panel member to the inner liner such that the inner liner is disposed adjacent to the interior-facing side 112 of the door panel member. Alternatively, in some embodiments, the inner liner 116 and the door panel member 108 may be integrally (or substantially integrally) formed from a single material, such as stainless steel or a polymeric material. When the door 102 is fully assembled (e.g., as in FIGS. 1 and 2), the door panel member 108 and inner liner 116 may be coupled to an outer door member 118.

One or more wires 120 may connect to and extend from the control panel 106 and along the interior of the door 102. For example, the wires 120 may extend between the outer door member 118 and the door panel member 108 (i.e., along the exterior-facing side 114 of the door panel member). The wires 120 serve to provide electrical communication between the control panel 106 and the components that accomplish washing functions associated with a washing cycle of the dishwasher 100. The wires 120 may be contained within a sheath or wiring harness 122 that acts to group the wires as they extend along the interior of the door 102.

A fluid-directing member 124 may be operably engaged with the door panel member 108, for example, about the exterior-facing side 114. For example, when the door 102 is fully assembled (e.g., as in FIGS. 1 and 2), the fluid-directing member 124 may be disposed between the outer door member 118 and the door panel member 108, and may be compressed or otherwise maintained in a selected position therebetween in order to secure the fluid-directing member in position.

Referring to FIGS. 3-10, the fluid-directing member 124 can define a containment portion 126 that is configured to at least partially surround the liquid dispenser unit 110. The fluid-directing member 124 may define a conduit 128 in communication with the containment portion 126. Liquid that leaks from the liquid dispenser unit 110 towards the exterior-facing side 114 of the door panel member 108 may thus be contained by the containment portion 126 and channeled by the conduit 128. The fluid-directing member 124 can be configured such that, when the dishwasher 100 is operated and the door 102 is in the closed position (shown in FIG. 1), the conduit 128 extends vertically downward from the containment portion 126.

The fluid-directing member 124 may also define a wiring chase or wire conduit 130 that is laterally spaced-apart from the containment portion 126 and conduit 128. The wire conduit 130 may be configured to direct the wires 120 along the exterior-facing side 114 of the door panel member 108 and to maintain lateral separation between the wires 120 and the liquid dispenser unit 110. By maintaining the wires 120 in a laterally spaced-apart relationship relative to the liquid dispenser unit 110/containment portion 126/conduit 128, the wires may be protected from coming in contact with any liquids leaking from the liquid dispenser unit 110, which contact could lead to corrosion or other deterioration of the wires 120 and/or insulation therefor and, possibly, short circuits, which may represent a significant fire hazard. With the door 102 in the vertical closed position, such leaking liquids will tend to flow vertically down the conduit 128 and will remain laterally separated from the wires 120.

The dishwasher door 102 may further include a port 132 extending from the exterior-facing side 114 to the interior-facing side 112 of the door panel member 108. The conduit 128 may be configured to channel leaking liquid to the port 132, which may ultimately drain into the tub portion 104 of the dishwasher 100.

Figure 5:
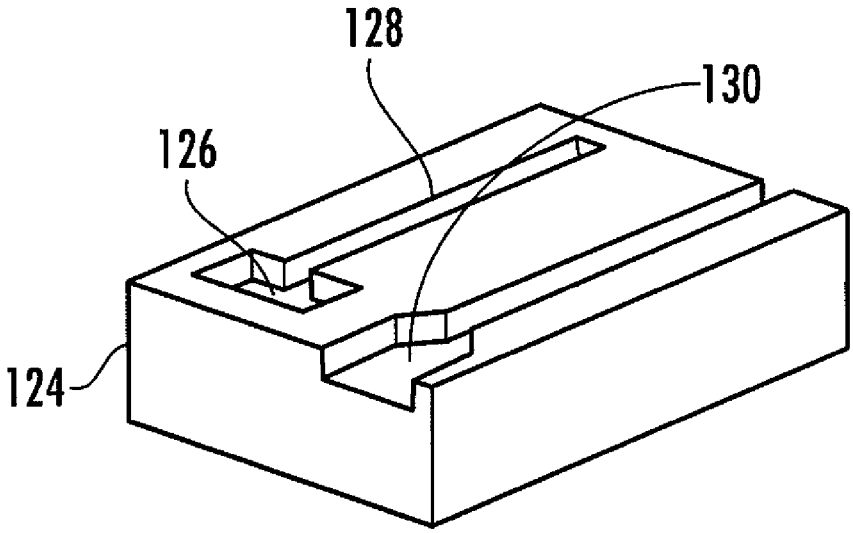
FIG. 5 is a perspective view of a fluid-directing member configured in accordance with an example embodiment.
Figure 6:
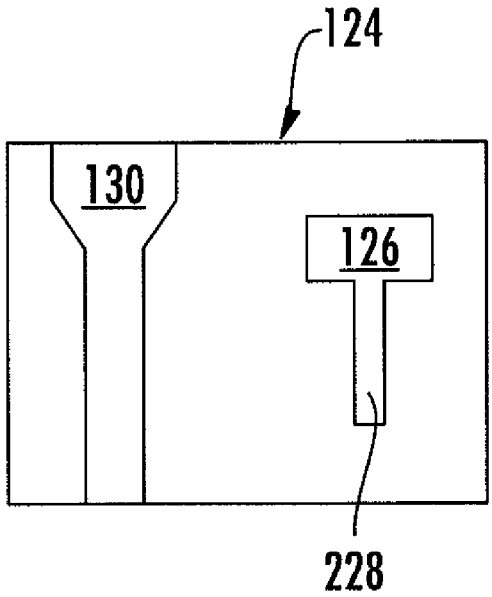
FIG. 6 is a plan view of the fluid-directing member of FIG. 5.

The fluid-directing member 124 may be a unitary structure, as shown, for example, in FIG. 5, or may be comprised of multiple components. In one embodiment, the fluid-directing member 124 may be formed as a unitary structure of, for example, expanded polystyrene foam or beads. In other embodiments, the fluid-directing member 124 may be formed of plastic via injection or rotational molding, or by forming or machining parts comprised of plastic, metal, etc.

Generally, the fluid-directing member can be configured to mechanically separate or isolate a variety of different structures as dictated by the target application. For example, referring to FIG. 11, therein is shown a fluid-directing member 224 configured in accordance with another example embodiment. The fluid-directing member 224 includes a containment portion 226 and a conduit 228 extending therefrom, and also a laterally spaced wire conduit 230. The containment portion 226 is bounded by walls 240 that slope toward the conduit 228. The sloped walls 240 thereby facilitate the flow of liquids from various areas within the containment portion 226 towards and though the conduit 228.

Many modifications and other embodiments of the inventions set forth herein will come to mind to one skilled in the art to which these inventions pertain having the benefit of the teachings presented in the foregoing descriptions and the associated drawings. For example, while the above described embodiments have all involved dishwashers, the underlying concepts disclosed therein are also applicable to other devices and contexts, such as, for example, refrigerators and automotive applications. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A dishwasher door comprising:

a door panel member having a liquid dispenser unit mounted thereto and extending therethrough from an interior-facing side to an exterior-facing side of said door panel member such that the liquid dispenser unit is configured to dispense a liquid from the interior-facing side and away from the exterior-facing side; and a fluid-directing member operably engaged with said door panel member about the exterior-facing side, wherein said fluid-directing member defines a containment portion that at least partially receives and surrounds said liquid dispenser unit, the containment portion configured to contain liquid leaking from said liquid dispenser unit toward the exterior-facing side of said door panel member, wherein the fluid-directing member includes a conduit in communication with the containment portion configured to channel the leaking liquid from the containment portion and through said door panel member, away from the exterior-facing side of said door panel member.

2. The dishwasher door according to claim 1, further comprising at least one wire extending along the exterior-facing side of said door panel member in laterally spaced-apart relation to said containment portion and conduit.

3. The dishwasher door according to claim 2, wherein said fluid-directing member defines a wire conduit that is laterally spaced-apart from said containment portion and conduit and configured to direct said at least one wire along the exterior-facing side of the door panel member.

4. The dishwasher door according to claim 2, wherein said at least one wire is configured to be connected to a control panel coupled to said dishwasher door.

5. The dishwasher door according to claim 1, wherein said door panel member is configured to be pivotably mounted to a tub portion of a dishwasher.

6. The dishwasher door according to claim 5, wherein said door panel member is configured to pivot into a closed position relative to the tub portion, whereby said door panel member is substantially vertically-oriented such that the conduit defined by said fluid-directing member extends downwardly from said containment portion.

7. The dishwasher door according to claim 1, further comprising a port extending from the exterior-facing side to the interior-facing side of said door panel member, and wherein the conduit is configured to channel leaking liquid to said port about said exterior-facing side.

8. The dishwasher door according to claim 1, wherein said fluid-directing member is a unitary structure.

9. A leak protection apparatus for a dishwasher door including a door panel member having a liquid dispenser unit mounted thereto and extending therethrough from an interior-facing side to an exterior-facing side of said door panel member such that the liquid dispenser unit is configured to dispense a liquid from the interior-facing side and away from the exterior-facing side, said leak protection apparatus comprising:

a fluid-directing member defining a containment portion and including a conduit in communication with and extending from the containment portion, said fluid-directing member being adapted to operably engage the exterior-facing side of the door panel member such that said containment portion at least partially receives and surrounds the liquid dispenser unit, the containment portion configured to contain liquid leaking from said liquid dispenser unit toward the exterior-facing side of said door panel member, the conduit being configured to channel the leaking liquid from the containment portion, and through the door panel member, away from the exterior-facing side of the door panel member.

10. The leak protection apparatus according to claim 9, wherein said fluid-directing member defines a wire conduit that is laterally spaced-apart from said containment portion and conduit and configured to direct at least one wire along the exterior-facing side of the door panel member when said fluid-directing member is operably engaged with the door panel member.

11. The leak protection apparatus according to claim 9, wherein said fluid-directing member is a unitary structure.

12. A door comprising:

a door panel member having a liquid dispenser unit mounted thereto and extending therethrough from an interior-facing side to an exterior-facing side of said door panel member such that the liquid dispenser unit is configured to dispense a liquid from the interior-facing side and away from the exterior-facing side; and a fluid-directing member operably engaged with said door panel member about the exterior-facing side of the door panel member, wherein the fluid-directing member defines a containment portion that at least partially receives and surrounds said liquid dispenser unit, the containment portion configured to contain liquid leaking from said liquid dispenser unit toward the exterior-facing side of said door panel member, wherein the fluid-directing member further includes a conduit in communication with the containment portion configured to channel the leaking liquid from the containment portion and through said door panel member, away from the exterior-facing side of said door panel member.

13. The door according to claim 12, further comprising at least one wire extending along the exterior-facing side of said door panel member in laterally spaced-apart relation to said containment portion and conduit.

14. The door according to claim 13, wherein said fluid-directing member defines a wire conduit that is laterally spaced-apart from said containment portion and conduit and configured to direct said at least one wire along the exterior-facing side of the door panel member.

15. The door according to claim 13, wherein said at least one wire is configured to be connected to a control panel coupled to said door.

16. The door according to claim 12, wherein said door panel member is configured to be pivotably mounted to a tub portion such that said door panel member selectively encloses the tub portion.

17. The door according to claim 16, wherein said door panel member is configured to pivot into a closed position relative to the tub portion, whereby said door panel member is substantially vertically-oriented such that the conduit defined by said fluid-directing member extends downwardly from said containment portion.

18. The door according to claim 12, further comprising a port extending from the exterior-facing side to the interior-facing side of said door panel member, and wherein the conduit is configured to channel leaking liquid to said port about said exterior-facing side.

19. The door according to claim 12, wherein said fluid-directing member is a unitary structure.

20. A leak control system for a dishwasher, comprising:

an inner door panel member pivotably mounted to a tub portion and having a liquid dispenser unit mounted thereto such that the liquid dispenser unit is configured to dispense a liquid into the tub portion, the liquid dispenser unit having a portion extending through the inner door panel member;

a fluid-directing member operably engaged with an outward side of inner door panel member and defining a containment portion that at least partially receives and surrounds the portion of the liquid dispenser unit extending through the inner door panel member to contain any liquid leaking from the liquid dispenser unit, outwardly of the outward side of the inner door panel member, the fluid-directing member further defining a channel member in communication with the containment portion configured to channel the leaking liquid from the containment portion to a port extending into the tub portion of the dishwasher.

21. The system according to claim 20, wherein the fluid-directing member at least partially defines a wiring chase in laterally spaced apart relation with respect to the containment portion and channel member defined by the fluid-directing member, the wiring chase being configured to contain therein any wiring extending to a console of the dishwasher so as to prevent the wiring from being contacted by the leaking liquid.

22. A dishwasher comprising:

a tub portion; and a door pivotably coupled to said tub portion, said door including:

a door panel member having a liquid dispenser unit mounted thereto and extending therethrough from an interior-facing side to an exterior-facing side of said door panel member such that the liquid dispenser unit is configured to dispense a liquid into the tub portion; and a fluid-directing member operably engaged with said door panel member about the exterior-facing side, wherein said fluid-directing member defines a containment portion that at least partially receives and surrounds said liquid dispenser unit, the containment portion configured to contain liquid leaking from said liquid dispenser unit toward the exterior-facing side of said door panel member, wherein the fluid-directing member further includes a conduit in communication with the containment portion configured to channel the leaking liquid from the containment portion and through said door panel member, away from the exterior-facing side of said door panel member.

23. The dishwasher according to claim 22, wherein said door further includes at least one wire extending along the exterior-facing side of said door panel member in laterally spaced-apart relation to said containment portion and conduit.

24. The dishwasher according to claim 23, wherein said fluid-directing member defines a wire conduit that is laterally spaced-apart from said containment portion and conduit and configured to direct said at least one wire along the exterior-facing side of the door panel member.

25. The dishwasher according to claim 23, further comprising a control panel coupled to said dishwasher door, and wherein said at least one wire is configured to be connected to said control panel.

26. The dishwasher according to claim 22, wherein said door panel member is configured to pivot into a closed position relative to said tub portion, whereby said door panel member is substantially vertically-oriented such that the conduit defined by said fluid-directing member extends downwardly from said containment portion.

27. The dishwasher according to claim 22, wherein said door further comprises a port extending from the exterior-facing side to the interior-facing side of said door panel member, and wherein the conduit is configured to channel leaking liquid to said port about said exterior-facing side.

28. The dishwasher according to claim 22, wherein said fluid-directing member is a unitary structure.

* * * * *